United States Patent [19]

Collins et al.

[11] Patent Number: 4,589,338

[45] Date of Patent: May 20, 1986

[54] FLEXOGRAPHIC PLATE MOUNTING APPARATUS AND METHOD

[76] Inventors: Billy Collins, R.R. #1, Vineland, Ontario; James F. Collins, R.R. #2, Caistor Centre, Ontario, both of Canada

[21] Appl. No.: 654,085

[22] Filed: Sep. 25, 1984

[30] Foreign Application Priority Data

Feb. 17, 1984 [CA] Canada ..... 447669

[51] Int. Cl.[4] ..... B41F 5/00; B41F 5/20; B41F 1/28; B41F 27/12

[52] U.S. Cl. ..... 101/216; 101/415.1; 101/DIG. 12

[58] Field of Search ..... 101/212, 216, 415.1, 101/DIG. 12

[56] References Cited

U.S. PATENT DOCUMENTS

| | | | |
|---|---|---|---|
| 1,820,551 | 8/1931 | Wood | 101/12 |
| 2,539,965 | 1/1951 | Moss | 101/DIG. 12 |
| 2,711,691 | 6/1955 | Leavens | 101/DIG. 12 |
| 3,186,336 | 6/1965 | Kirby | 101/DIG. 12 |
| 3,347,161 | 10/1967 | Lenk | 101/DIG. 12 |
| 3,390,633 | 7/1968 | Boughton | 101/415.1 |
| 4,034,671 | 7/1977 | Bach | 101/426 |

FOREIGN PATENT DOCUMENTS

| | | | |
|---|---|---|---|
| 0724050 | 12/1965 | Canada . | |
| 975217 | 9/1975 | Canada . | |
| 1027803 | 3/1978 | Canada . | |
| 2122546 | 1/1984 | United Kingdom | 101/DIG. 12 |

*Primary Examiner*—Edgar S. Burr
*Assistant Examiner*—William L. Klima

[57] ABSTRACT

In printing with flexographic plates it is essential that each plate be accurately positioned on the plate cylinders. The mounting apparatus and method of this invention provide a register cylinder on which the flexographic plate is positioned by registration pins. The plate cylinder on which the flexographic plate is to be mounted is positioned in a predetermined rotational position on a mounting so that it can be moved towards and away from the register cylinder. The register cylinder is then rotated to a predetermined position and the plate cylinder brought into abutment with the flexographic plate and register cylinder. The registration pins are then retracted and both cylinders rotated to transfer the flexographic plate to the outer surface of the plate cylinder in registration. The plate adheres to the cylinder surface either by an adhesive substance, such as double sided tape, or magnetically.

4 Claims, 7 Drawing Figures

FLEXOGRAPHIC PLATE MOUNTING APPARATUS AND METHOD

BACKGROUND OF THE INVENTION

1. Field of the Invention

The present invention relates to an apparatus and method for applying flexographic printing plates to the plate cylinders of printing machines.

It is essential that the flexographic plate be accurately positioned on each plate cylinder in order that images printed in different colours by different cylinders are in registration.

2. Description of Related Art

Canadian Pat. No. 975,217 issued to Chromax Limited on Sept. 30, 1975 shows a machine for such a purpose in which a flexographic printing plate is first positioned on a slide. The slide is then moved relatively to a printing cylinder and pressure sensitive adhesive on the reverse side of the flexographic plate causes it to stick to and wrap around the cylinder in registration.

The present invention provides an improved, compact and simple apparatus which first positions the flexographic printing plate on a register cylinder by means of register pins and then transfers the plate to a plate cylinder. The plate is retained on the plate cylinder surface magnetically or by an adhesive substance.

Specifically the invention relates to apparatus for mounting a flexographic plate in registration on a plate cylinder, the flexographic plate being provided with registration holes at one end thereof. The apparatus comprises: a register cylinder capable of controlled rotation and provided with a row of apertures to receive retractible registration pins at selected locations, means supporting a flexographic plate with the one end supported by the register cylinder and the registration holes engaged by registration pins, means for first rotating the register cylinder a precise amount whereby the flexographic plate is positioned for transfer to a plate cylinder, a movable plate cylinder support for receiving a plate cylinder at a predetermined rotational position, whereby the plate cylinder may abut the flexographic plate and register cylinder after the register cylinder has performed its first rotation, and means for further rotating the register cylinder when abutting the plate cylinder whereby the flexographic plate is transferred to the plate cylinder in registration.

In its method aspect the invention relates to a method for mounting a flexographic plate in registration on a plate cylinder by use of a register cylinder capable of controlled rotation and provided with a row of apertures to receive retractable registration pins at selected locations. The method comprises the steps of: positioning the flexographic plate with holes at one end engaging the pins in the register cylinder, rotating the register cylinder a precise amount, positioning the plate cylinder at a predetermined rotational position abutting the flexographic plate and register cylinder, retracting the registration pins and rotating both the register cylinder and plate cylinder whereby the flexographic plate transfers to the plate cylinder in registration.

BRIEF DESCRIPTION OF THE DRAWINGS

A specific embodiment of the invention will now be described in conjunction with the accompanying drawings, in which.

DESCRIPTION OF THE PREFERRED EMBODIMENT

Figure 1:
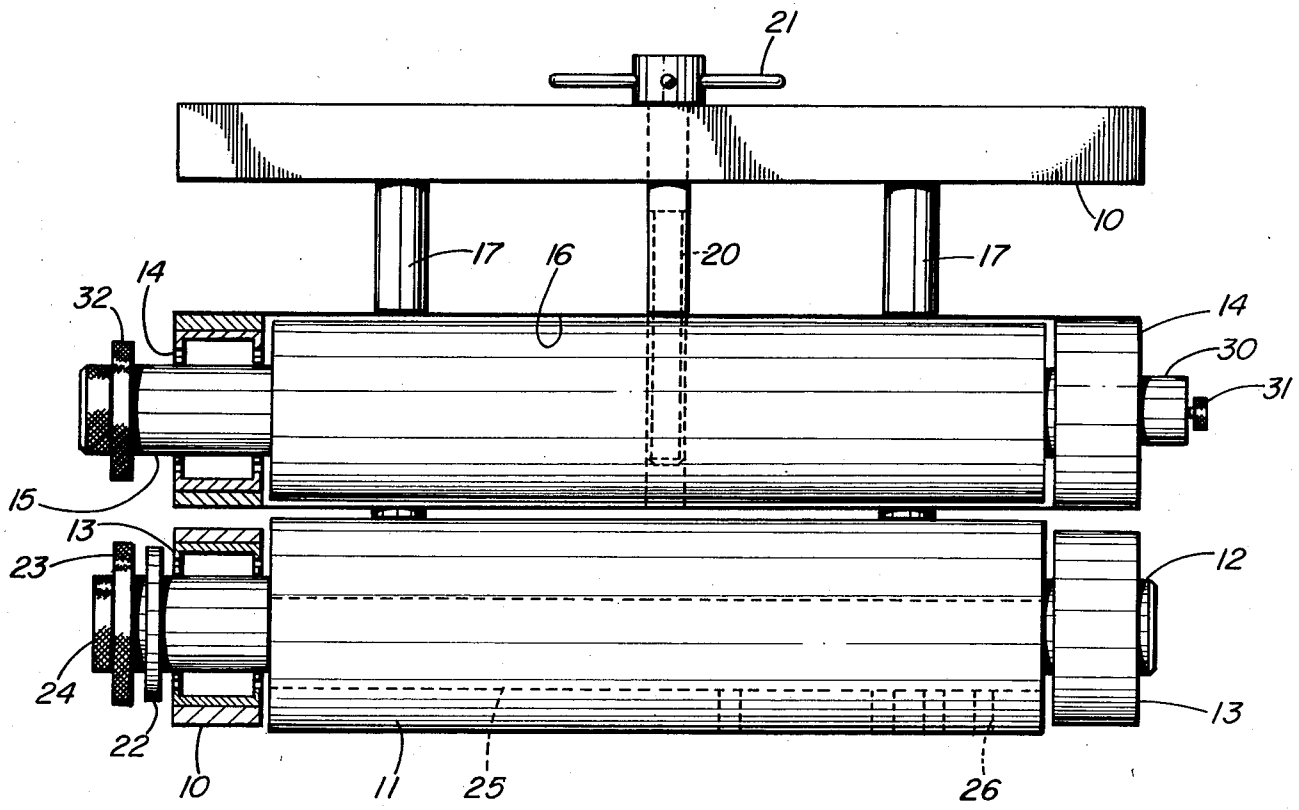
FIG. 1 is a plan view of the apparatus of the invention.
Figure 2:
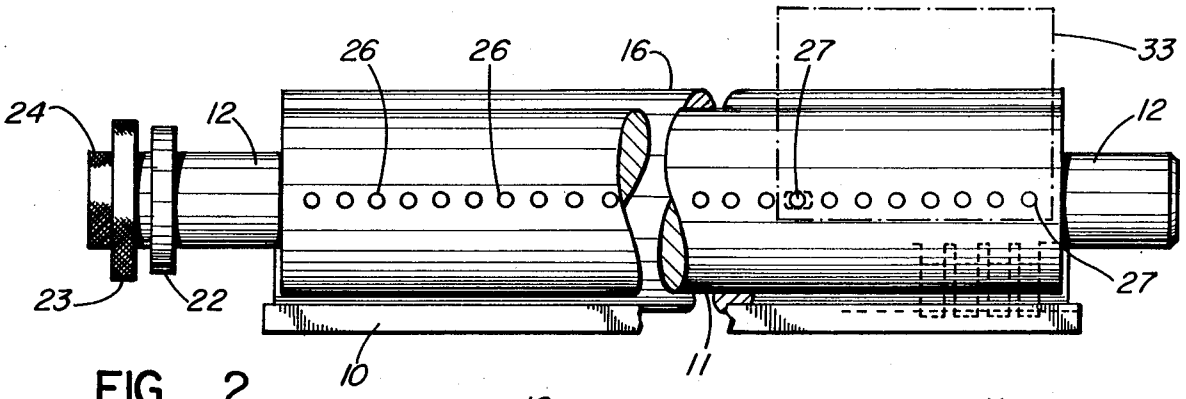
FIG. 2 is a front view of the apparatus shown in FIG. 1 with the positioning tray shown in phantom.

FIGS. 1 and 2 show two views of the plate mounting apparatus of the present invention. An underlying support or base member 10 has bearing journals 13 supporting stub support shafts 12 of a register cylinder 11. At the end of the left hand stub support shaft, referring to FIG. 1, there is provided an index plate 22, a hand wheel 23 and a cam control knob 24. Index plate 22 is used for locking the register cylinder in positions spaced exactly 180° apart, as will be more fully described below. Hand wheel 23 is used by an operator to rotate the register cylinder during use and cam control knob 24 adjusts the position of an internal cam 25. Cam 25 cooperates with a series of holes 26 which are adapted to receive register pins 27. In the position of the cam shown in FIG. 1 the register pins are maintained with an end protruding outwardly from the cylinder, to retain a flexographic plate 33 thereon as shown in phantom in FIG. 2, and in the other position of the cam it permits the pins to be wholly retracted within the cylinder. Cylinders with retractable pins are known such as those shown in Canadian Pat. No. 724,050, issued Dec. 21, 1965 to Raybuck and Canadian Pat. No. 1,027,803, issued Mar. 14, 1978 to Gubela.

Bearing journals 14 are provided adjacent to the register cylinder to receive a plate cylinder 16 from a conventional printing machine. Cylinder 16 has stub support shafts 15 and is adjusted to fit axially by knob 31 of an adjustment mechanism 30. Normally, the print cylinder is provided with a helical drive gear 32, at the end opposite from adjusting mechanism 30, and this is used to lock the cylinder against rotation as described more fully below.

The plate cylinder bearing journals 14 are movable on guide members 17 so that the plate cylinder can be moved towards and away from register cylinder 11 under control of the operator by using handle 21 controlling threaded rod 20. Adjustable supports to receive a removable plate cylinder are shown, for example, in U.S. Pat. No. 3,347,161, issued Oct. 17, 1967, to Lenk and in U.S. Pat. No. 3,390,633, issued July 2, 1968, to Broughton.

Figure 3:
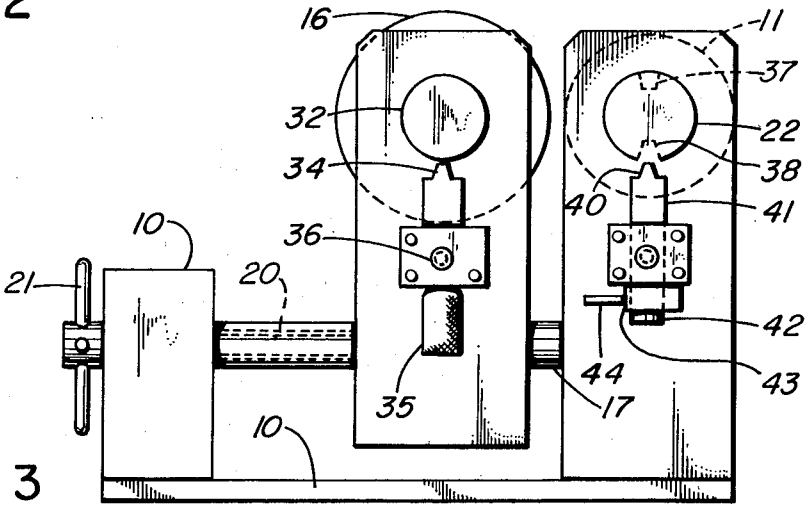
FIG. 3 is a side view of the apparatus showing the locking mechanism for each of the cylinders.
Figure 4:
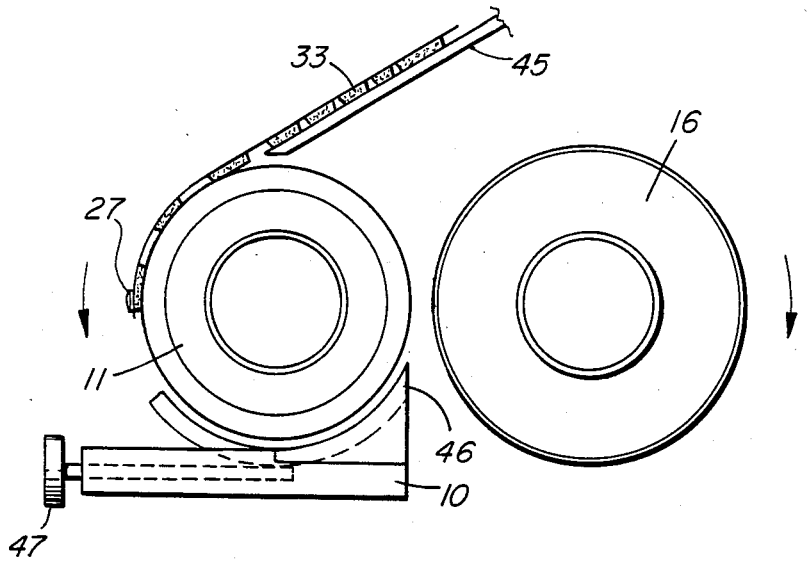
FIGS. 4–7 show the sequence of operation of the apparatus.
Figure 5:
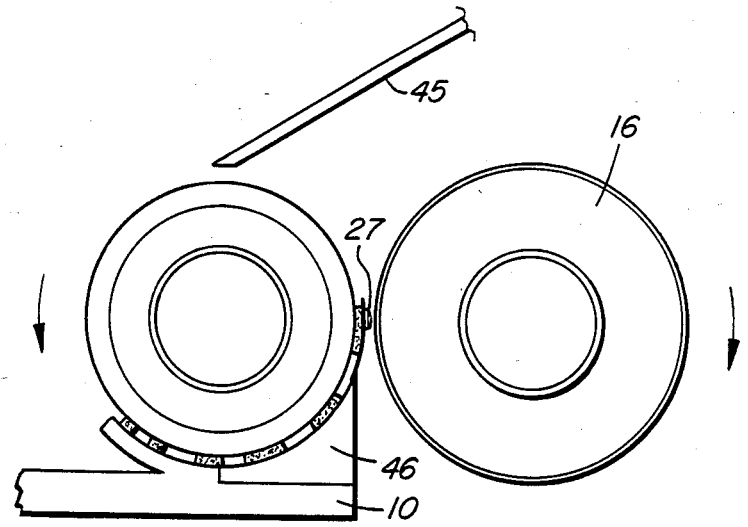

FIG. 3 shows the mechanism employed to lock the plate cylinder and register cylinder against rotation at selected times during operation of the apparatus. A movable locating pin 34 engages with a tooth of helical gear 32. The position of pin 34 is controlled by a screw thread driven by knob 35 and may be locked in position by a further knob 36. So far as the register cylinder is concerned, index plate 22 is provided with opposed locking recesses 37 and 38 spaced exactly by 180° which cooperate with a locating pin 40 carried by a slidable plate 41. Plate 41 is spring biased so as to be urged into engagement with the index plate. It can be pulled downwardly by a tongue portion 42 extending at right angles to the plane of FIG. 3. Plate 41 can be held in the retracted position by a spacer block 43 which may be pivoted to occupy the space above tongue 42 by means of a handle 44.

Referring now to FIGS. 4–7, a positioning tray 45 extends downwardly towards the upper part of register cylinder 11. An adjustably mounted, channelled guide member 46 is carried by base 10. The function of the guide member is to maintain tension in the flexographic plate and guide it as the register cylinder rotates. The spacing between the register cylinder 11 and the exit portion of guide member 46 can be varied to accommodate flexographic plates of varying thickness by a screw adjusting mechanism controlled by knob 47.

In operation, a flexographic plate 33 is positioned face downwardly on the positioning tray 45 and register holes at one end of the flexographic plate are engaged by pins 27 placed in appropriate holes 26 in register cylinder 11. The apparatus is then in the position shown in FIG. 4. The register cylinder is then rotated through 180° to the position shown in FIG. 5 where the flexographic plate is supported by register pins 27 and by the guide member 46.

Figure 6:
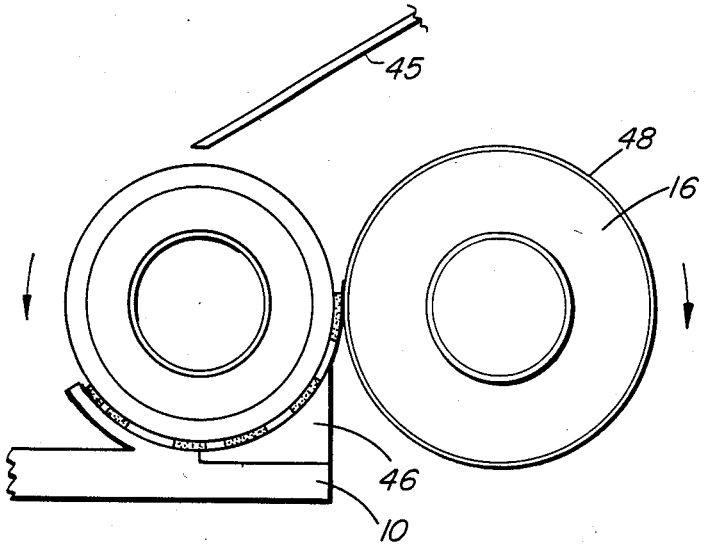

The plate cylinder 16 is then adjusted by means of handle 21 to abut the flexographic plate 33 and the register cylinder 11 as shown in FIG. 6. An adhesive surface 48 provided on plate cylinder 16 engages the rear surface of flexographic plate 33 and under the pressure of the plate cylinder, register pins 27 retract into holes 26 in register cylinder 11.

Figure 7:
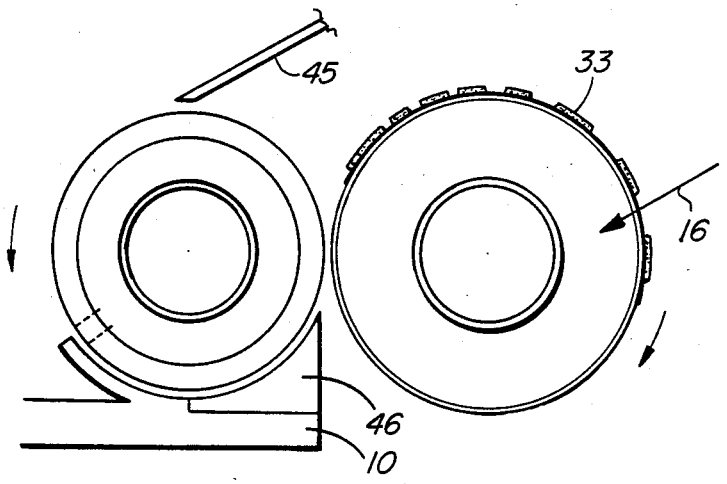

Plate cylinder 16 is then unlocked for rotation and register cylinder 11 is further rotated leading to the situation shown in FIG. 7 in which flexographic plate 33 has adhered to plate cylinder 16 in registration whereupon plate cylinder 16 may be removed and utilized in printing apparatus. Register cylinder 11 may then be returned to its original position ready to receive the next flexographic plate.

Thus, there has been described an apparatus and method useful for mounting flexographic plates in registration on a plate cylinder. It is contemplated that the flexographic plate can adhere to plate cylinder 16 by magnetic attraction as well as by other forms of adhesion.

We claim:

1. Apparatus for mounting a flexographic plate in registration on a plate cylinder, the flexographic plate having a printing surface and a back surface and being provided with registration holes at one end thereof, said apparatus comprising:

a register cylinder having a row of retractable registration pins, positioned in apertures in the surface thereof;

a plate cylinder positioned adjacent said register cylinder;

means including said registration pins for mounting and registering one end of a flexographic plate on said register cylinder with the printing surface of the flexographic plate positioned for contact with the surface of said register cylinder and with said registration pins extending into the registration holes of the flexographic plate;

means providing controlled, precise rotation of said register cylinder independently of said plate cylinder to locate the flexographic plate on the surface of said register cylinder with the printing surface of the flexographic plate in contact with the register cylinder surface, and to position the flexographic plate for transfer to said adjacent plate cylinder;

a moveable plate cylinder support for receiving said plate cylinder at a predetermined rotational position;

means for moving the plate cylinder to abut a flexographic plate mounted on said register cylinder after the register cylinder has been independently rotated to position the flexographic plate for transfer;

means permitting the registration pins to retract into the register cylinder under pressure from said plate cylinder to release the flexographic plate from said register cylinder; and means to transfer the flexographic plate from said register cylinder to said plate cylinder including means for further rotating said register cylinder and said plate cylinder in unison, whereby the flexographic plate is transferred to the plate cylinder in registration, with the back surface of the flexographic plate in contact with the surface of said plate cylinder.

2. Apparatus as set out in claim 1, wherein said means mounting and registering one end of a flexographic plate includes a positioning tray adjacent said register cylinder and adapted to receive a flexographic plate with the printing surface in a downward position.

3. Apparatus as set out in claim 2 further including guide means positioned adjacent said register cylinder on the opposite side from said tray to ensure said flexographic plate is retained on said register cylinder during said rotation of said register cylinder.

4. A method for mounting a flexographic plate having registration apertures along one end, and having a printing surface and a back surface, in registration on a plate cylinder by use of a register cylinder, comprising:

mounting a register cylinder for controlled rotation, said register cylinder having a row of retractable registration pins extending through apertures in the surface thereof;

mounting a plate cylinder adjacent the register cylinder;

positioning a flexographic plate adjacent the register cylinder with said one end in contact with the surface of the register cylinder and said registration apertures engaging said registration pins, the printing surface of the flexographic plate being positioned for contact with the surface of the register cylinder;

rotating the register cylinder a precise, controlled amount, independently of the plate cylinder, to locate the flexographic plate on the surface of the register cylinder with the printing surface of the flexographic plate in contact with the register cylinder surface and to position the flexographic plate for transfer to an adjacent plate cylinder;

positioning the plate cylinder at a predetermined rotational position abutting the flexographic plate and register cylinder;

retracting the registration pins under pressure from the plate cylinder to release the flexographic plate from the register cylinder; and rotating said register cylinder and said plate cylinder in unison to transfer the flexographic plate to the plate cylinder in registration, with the back surface of the flexographic plate in contact with the surface of the plate cylinder.

* * * * *